US005761595A

United States Patent [19]

Tarnawskyj et al.

[11] Patent Number: 5,761,595

[45] Date of Patent: Jun. 2, 1998

[54] INTERMEDIATE TRANSFER MEMBERS

[75] Inventors: Ihor W. Tarnawskyj, Webster; Kock-Yee Law, Penfield; Joseph Mammino, Penfield; Robert M. Ferguson, Penfield; Martin A. Abkowitz, Webster, all of N.Y.

[73] Assignee: Xerox Corporation, Stamford, Conn.

[21] Appl. No.: 779,287

[22] Filed: Jan. 21, 1997

[51] Int. Cl.[6] ..... G03G 15/16

[52] U.S. Cl. ..... 399/308; 399/297; 428/421; 430/126; 525/199

[58] Field of Search ..... 399/297, 302, 399/308, 310, 313; 430/48, 126; 428/35.7, 195, 206, 411.1, 421, 425, 473.5; 525/199; 492/16, 18

[56] References Cited

U.S. PATENT DOCUMENTS

| | | | |
|---|---|---|---|
| 3,893,761 | 7/1975 | Buchan et al. | 399/308 |
| 4,524,119 | 6/1985 | Luly et al. | 430/108 |
| 5,089,856 | 2/1992 | Landa et al. | 399/308 |
| 5,132,743 | 7/1992 | Bujese et al. | 399/302 |
| 5,208,638 | 5/1993 | Bujese et al. | 399/310 |
| 5,266,431 | 11/1993 | Mammino et al. | 430/126 X |
| 5,340,679 | 8/1994 | Badesha et al. | 430/126 |
| 5,430,103 | 7/1995 | Ohata et al. | 525/199 X |
| 5,456,987 | 10/1995 | Badesha | 428/421 |
| 5,537,194 | 7/1996 | Henry et al. | 399/308 |
| 5,567,565 | 10/1996 | Larson et al. | 430/126 |
| 5,669,052 | 9/1997 | Kusaba et al. | 399/308 |

FOREIGN PATENT DOCUMENTS

| | | |
|---|---|---|
| 7-160138-A | 12/1993 | Japan . |
| 6-170013-A | 6/1994 | Japan . |
| 8-160759-A | 12/1994 | Japan . |

*Primary Examiner*—Arthur T. Grimley
*Assistant Examiner*—Sophia S. Chen
*Attorney, Agent, or Firm*—Annette L. Bade

[57] ABSTRACT

A resistive transfer component having a fluorinated carbon filled fluoroelastomer, and in embodiments, the resistive transfer component with an optional polyimide substrate, and an optional outer silicone release layer.

20 Claims, 2 Drawing Sheets

INTERMEDIATE TRANSFER MEMBERS

CROSS REFERENCE TO RELATED APPLICATIONS

Attention is directed to the following copending applications assigned to the assignee of the present application: U.S. application Ser. No. 08/672,803 filed Jun. 24, 1996, entitled, "Biasable Charging Members;" U.S. application Ser. No. 08/635,356 filed Apr. 16, 1996, entitled, "Biasable Transfer Members;" U.S. application Ser. No. 08/786,614 filed Jan. 21, 1997, entitled, "Ohmic Contact-Providing Composites;" U.S. application Ser. No. 08/706,057 filed Aug. 28, 1996, entitled, "Fixing Apparatus and Film," U.S. application Ser. No. 08/706,387 filed Aug. 28, 1996, entitled, "Instant On Fuser System Members, and" U.S. application Ser. No. 08/808,775 filed Mar. 3, 1997, entitled "Electrically Conductive Coatings;" and U.S. application Ser. No. 08/808,765 filed Mar. 3, 1997, entitled "Electrically Conductive Processes." The disclosures of each of these applications are hereby incorporated by reference in their entirety.

BACKGROUND OF THE INVENTION

The present invention relates to intermediate transfer components, and more specifically, to intermediate transfer components useful in transferring a developed image in an electrostatographic, especially xerographic machine or apparatus. In embodiments of the present invention, there are selected intermediate transfer components comprising a layer comprising a polymer, preferably a fluoropolymer, and particularly preferred a fluorinated carbon filled fluoroelastomer. In embodiments, the present invention allows for the preparation and manufacture of intermediate transfer components with excellent electrical, chemical and mechanical properties, including controlled resistivity in a desired resistivity range and excellent conformability. Further, in embodiments, the intermediate transfer components also exhibit excellent chemical and electrical properties such as statistical insensitivity of conductivity to increases in temperature and to environmental changes. Moreover, the intermediate transfer components herein, in embodiments, allow for high transfer efficiencies to and from intermediates even for full color images and can be useful in both dry and liquid toner developments systems.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Generally, the electrostatic latent image is developed by bringing a developer mixture into contact therewith. A dry developer mixture usually comprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and the toner particles are deposited thereon in image configuration. After the toner particles have been deposited on the photoconductive surface, in image configuration, it is transferred to a copy sheet. However, when a liquid developer material is employed, the copy sheet is wet with both the toner particles and the liquid carrier. Thus, it is necessary to remove the liquid carrier from the copy sheet. This may be accomplished by drying the copy sheet prior to fusing of the toner image, or relying upon the fusing process to permanently fuse the toner particles to the copy sheet as well as vaporizing the liquid carrier adhering thereto. It is desirable to refrain from transferring any liquid carrier to the copy sheet. Therefore, it is advantageous to transfer the developed image to a coated intermediate transfer web, belt or component, and subsequently transfer with very high transfer efficiency the developed image from the intermediate transfer component to a permanent substrate. The toner image is usually fixed or fused upon a support which may be the photosensitive member itself or other support sheet such as plain paper.

In electrostatographic printing machines wherein the toner image is electrostatically transferred by a potential between the imaging member and the intermediate transfer member, the transfer of the toner particles to the intermediate transfer member and the retention thereof should be as complete as possible so that the image ultimately transferred to the image receiving substrate will have a high resolution. Substantially 100% toner transfer occurs when most or all of the toner particles comprising the image are transferred and little residual toner remains on the surface from which the image was transferred. Substantially 100% toner transfer is especially important for generating full color images since undesirable shifting or color deterioration in the final colors can occur when the primary color images are not accurately and efficiently transferred to and from the intermediate transfer members.

Although intermediate transfer members allow for positive attributes such as enabling high throughput at modest process speeds, improving registration of the final color toner image in color systems using synchronous development of one or more component colors using one or more transfer stations, and increasing the range of final substrates that can be used, a disadvantage of using an intermediate transfer member is that a plurality of transfer steps is required allowing for the possibility of charge exchange occurring between toner particles and the transfer member which ultimately leads to less than complete toner transfer. The result is low resolution images on the image receiving substrate and image deterioration. When the image is in color, the image additionally suffers from color shifting and color deterioration. In addition, the use of charging agents in liquid developers, although providing good quality images and acceptable resolution due to improved charging of the toner, can exacerbate the problem of charge exchange between the toner and the intermediate transfer member.

To help decrease charge exchange and increase toner transfer, the resistivity of the intermediate transfer member should be within a desired range, and preferably, wherein the resistivity is virtually unaffected by changes in humidity, temperature, bias field, and operating time. Attempts at controlling the resistivity of intermediate transfer members have been accomplished by, for example, adding conductive fillers such as ionic additives and/or carbon black to the conformable layer.

U.S. Pat. No. 5,567,565 discloses a fluorocarbon elastomer intermediate transfer member for use with liquid developers and which achieves substantially 100% toner transfer.

U.S. Pat. No. 5,537,195 discloses an intermediate transfer member for use with liquid developers, wherein the intermediate transfer member comprises a fluorocarbon elastomer with metal oxide fillers therein.

U.S. Pat. No. 5,525,446 discloses an intermediate transfer member for use with color systems which includes a base layer and a top polycarbonate layer, wherein the top layer can include electrical property regulating materials such as metal oxides or carbon black.

U.S. Pat. No. 5,456,987 discloses an intermediate transfer component for both dry and liquid toner, comprising a substrate and a coating comprised of integral, interpenetrating networks of haloelastomer, titanium oxide and optionally polyorganosiloxane, wherein the substrate may include dielectric or conductive fillers such as carbon or metal oxide particles.

U.S. Pat. No. 5,340,679 discloses an intermediate transfer component for both dry and liquid toner, wherein the intermediate transfer component comprises a substrate and thereover a coating comprised of a volume grafted elastomer, wherein the substrate may include dielectric or conductive fillers such as carbon or metal oxide particles.

U.S. Pat. No. 5,337,129 discloses an intermediate transfer component useful in dry and/or liquid toner systems, wherein the intermediate transfer component comprises a substrate and a coating comprised of integral, interpenetrating networks of haloelastomer, silicon oxide and optionally polyorganosiloxane, wherein the substrate may include dielectric or conductive fillers such as carbon or metal oxide particles.

U.S. Pat. No. 5,208,638 discloses an intermediate transfer surface for use with liquid color toners, wherein the intermediate transfer surface comprises a conductive material dispersed in a fluoroelastomer layer, wherein carbon black is employed as the conductive dispersion or filler in order to affect the electrical conductivity of the surface.

While the addition of electrically ionic additives to polymers may partially control the resistivity of the polymers to some extent, there are problems associated with the use of these additives. In particular, undissolved particles frequently bloom or migrate to the surface of the polymer and cause an imperfection in the polymer. This leads to a nonuniform resistivity, which in turn, causes poor antistatic properties and poor mechanical strength. The ionic additives on the surface may interfere with toner release and affect toner offset. Furthermore, bubbles appear in the conductive polymer, some of which can only be seen with the aid of a microscope, others of which are large enough to be observed with the naked eye. These bubbles provide the same kind of difficulty as the undissolved particles in the polymer namely, poor or nonuniform electrical properties and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from 20% to 80% relative humidity. This effect limits the operational or process latitude.

Moreover, ion transfer can also occur in these systems. The transfer of ions will lead to charge exchanges and insufficient transfers, which in turn, will cause low image resolution and image deterioration, thereby adversely affecting the copy quality. In color systems, additional adverse results are color shifting and color deterioration. Ion transfer also increases the resistivity of the polymer member after repetitive use. This can limit the process and operational latitude and eventually the ion-filled polymer component will be unusable.

Carbon black particles can impart other specific adverse effects. Such carbon dispersions are difficult to prepare due to carbon gelling, and the resulting layers may deform due to gelatin formation. This can lead to an adverse change in the conformability of the intermediate transfer member, which in turn, can lead to insufficient transfer and poor copy quality, and possible contamination of other machine parts and later copies.

Generally, carbon additives tend to control the resistivities and provide somewhat stable resistivities upon changes in temperature, relative humidity, running time, and leaching out of contamination to photoconductors. However, the required tolerance in the filler loading to achieve the required range of resistivity has been extremely narrow. This, along with the large "batch to batch" variation, leads to the need for extremely tight resistivity control. In addition, carbon filled polymer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Therefore, there exists an overall need for an intermediate transfer member for use in both dry and liquid toner systems, which provides for increased toner transfer efficiency and a decrease in the occurrence of charge exchange. More specifically, there exists a specific need for an intermediate transfer member having controlled resistivity in a desired range so as to neutralize toner charges, thereby decreasing the occurrence of charge exchange, increasing image quality and preventing contamination of other xerographic members. In addition, there exists a specific need for an intermediate transfer member which has an outer surface having the qualities of a stable resistivity in the desired resistivity range and in which the conformability and low surface energy properties of the release layer are not affected.

SUMMARY OF THE INVENTION

Examples of objects of the present invention include:

It is an object of the present invention to provide resistive transfer components and methods thereof with many of the advantages indicated herein.

Another object of the present invention is to provide a resistive transfer component which has a desired resistivity.

Further, it is an object of the present invention to provide a resistive transfer component which has superior electrical properties including a stable resistivity in the desired resistivity range which is virtually unaffected by changes in humidity and temperature.

It is a further object of the present invention to provide a resistive transfer component which provides for substantially 100% toner transfer.

It is another object of the present invention to provide a resistive transfer component which reduces or eliminates the occurrence of charge exchange.

It is yet another object of the present invention to provide a resistive transfer component having a low surface energy surface.

A further object of the present invention is to provide a resistive transfer component which has good conformability.

The present invention includes, in embodiments: a resistive transfer component comprising at least one fluorinated carbon filled fluoroelastomer layer.

Embodiments of the present invention also include: a resistive transfer belt comprising at least one, and for example from 1 to about 5, fluorinated carbon filled fluoroelastomer layers.

Embodiments of the present invention further include: a resistive transfer belt for transferring a liquid image having at least a liquid carrier with toner particles dispersed therein from a member to a copy sheet, comprising a polyimide substrate, and having thereon a fluorinated carbon filled fluoroelastomer intermediate layer, and positioned thereon an outer silicone release layer.

In addition, embodiments of the present invention include: an apparatus for forming images on a recording medium comprising: a charge-retentive surface to receive an electrostatic latent image thereon; a development component to apply toner to said charge-retentive surface to develop said electrostatic latent image to form a developed image on said charge retentive surface; a resistive transfer component to transfer the developed image from said charge retentive surface to a copy substrate, wherein said intermediate transfer component comprising a polyimide substrate, and having thereon a fluorinated carbon filled fluoroelastomer intermediate layer, and positioned thereon an outer silicone release layer; and a fixing component for fusing toner images to a surface of said copy.

The transfer members provided herein, the embodiments of which are further described herein, in embodiments, are useful in both dry and liquid toner systems and are useful in color and multicolor systems. The intermediate transfer members herein, in embodiments, enable control of desired resistivities, allow for uniform electrical properties including resistivity, and neutralize toner charges, all of which contribute to good release properties, a decrease in the occurrence of charge exchange, an increase in image quality, and a decrease in contamination of other xerographic components such as photoconductors. The transfer members provided herein, in embodiments, also have improved insensitivities to environmental and mechanical changes, have low surface energy, and have good conformability.

BRIEF DESCRIPTION OF THE DRAWINGS

For a better understanding of the present invention, reference may be had to the accompanying figures.

DETAILED DESCRIPTION OF THE PRESENT INVENTION

The present invention relates to intermediate transfer systems comprising intermediate transfer members wherein the conformable layer comprises a fluorinated carbon filled fluoroelastomer.

Figure 1:
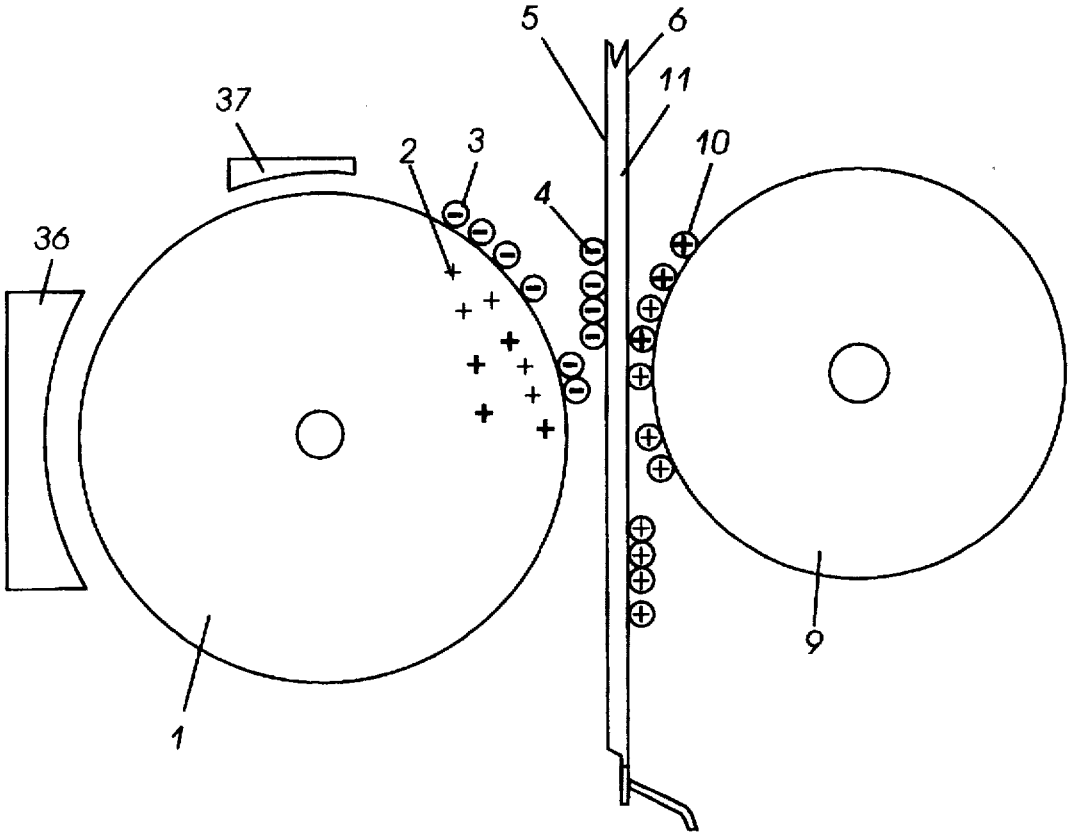
FIG. 1 is a schematic view of an image development system containing an intermediate transfer member.

FIG. 1 demonstrates an embodiment of the present invention and depicts an intermediate transfer member 11 positioned between an imaging member 1 and a transfer roller 9. The imaging member 1 is exemplified by a photoreceptor drum. However, other appropriate imaging members may include other electrostatographic imaging receptors such as ionographic belts and drums, electrophotographic belts, and the like.

In the multi-imaging system of FIG. 1, each image being transferred is formed on the imaging drum by image forming station 36. Each of these images is then developed at developing station 37 and transferred to intermediate transfer member 11. Each of the images may be formed on the photoreceptor drum 1 and developed sequentially and then transferred to the intermediate transfer member 11. In an alternative method, each image may be formed on the photoreceptor drum 1, developed, and transferred in registration to the intermediate transfer member 11. In a preferred embodiment of the invention, the multi-image system is a color copying system. In this color copying system, each color of an image being copied is formed on the photoreceptor drum. Each color image is developed and transferred to the intermediate transfer member 11. As above, each of the colored images may be formed on the drum 1 and developed sequentially and then transferred to the intermediate transfer member 11. In the alternative method, each color of an image may be formed on the photoreceptor drum 1, developed, and transferred in registration to the intermediate transfer member 11.

After latent image forming station 36 has formed the latent image on the photoreceptor drum 1 and the latent image of the photoreceptor has been developed at developing station 37, the charged toner particles 3 from the developing station 37 are attracted and held by the photoreceptor drum 1 because the photoreceptor drum 1 possesses a charge 2 opposite to that of the toner particles 3. In FIG. 1, the toner particles are shown as negatively charged and the photoreceptor drum 1 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 9 positioned opposite the photoreceptor drum 1 has a higher voltage than the surface of the photoreceptor drum 1. As shown in FIG. 1, biased transfer roller 9 charges the backside 6 of intermediate transfer member 11 with a positive charge. In an alternative embodiment of the invention, a corona or any other charging mechanism may be used to charge the backside 6 of the intermediate transfer member 11.

The negatively charged toner particles 3 are attracted to the front side 5 of the intermediate transfer member 11 by the positive charge 10 on the backside 6 of the intermediate transfer member 11.

The intermediate transfer member may be in the form of a sheet, web or belt as it appears in FIG. 1, or in the form of a roller or other suitable shape. In a preferred embodiment of the invention, the intermediate transfer member is in the form of a belt. In another embodiment of the invention, not shown in the figures, the intermediate transfer member may be in the form of a sheet.

It is desirable that the intermediate transfer member be comprised of materials that have good dimensional stability, are resistant to attack by materials of the toner or developer, and are conformable to image receiving substrates. The fluorocarbon elastomers of the present invention possess these properties. Conformability means that the material is able to contact an image receiving substrate with substantially complete smoothness, that is, that the material conforms to match the topography or contour of the surface of the substrate. The image produced on the substrate is high in resolution and has good image quality. An image transferred by an intermediate transfer member lacking conformability produces complete images having varying shades (i.e., areas lighter in color than other areas), low resolution images, color shifting, color deterioration and incomplete areas where the toner was unable to contact the substrate.

After the toner latent image has been transferred from the photoreceptor drum to the intermediate transfer member, the intermediate transfer member may be contacted under heat and pressure to an image receiving substrate such as paper. The toner image on the intermediate transfer member is then transferred and fixed, in image configuration, to the substrate.

In a preferred embodiment of the present invention, toner particles are supplied in a liquid developer form. Liquid developers comprise liquid carriers such as, for example, Isopar® (aliphatic hydrocarbons commercially available from Exxon Chemical Corporation) and Norpar® (high purity normal paraffinic liquids commercially available from Exxon Chemical Corporation). Toner particles are present in the liquid developer, and can include well known pigments and dyes as a colorant material. Resinous binders are also known for liquid developers, such as for example styrene/butadiene copolymers. Conventional additives such as plasticizers, surfactants and metal stearates may also be included in liquid developer compositions, such as for example, those disclosed in U.S. application Ser. No. 08/658,287 filed Jun. 3, 1996, now U.S. Pat. No. 5,672,457.

It is important in the transfer process that toner particles be nearly completely transferred both to and from the intermediate transfer member. As the number of toner particles that are not transferred increases, the resolution of the end image upon the image receiving substrate decreases. One of the single most significant factors contributing to the non-transfer of toner particles is charge exchange between the toner particles and the intermediate transfer member. The charge exchange results in wrong sign toner that does not transfer properly.

It is known in the art to include in liquid developers a charge director compound to improve the resultant image quality. The use of charge directors allows for some control over the toner particles' charge. Charge directors known and used in the art include Basic Barium Petronate® (an oil-soluble petroleum sulfonate available from Witco Chemical Corp.), as well as an AB diblock copolymer charge director as disclosed in U.S. Pat. No. 5,035,972, which is hereby incorporated by reference in its entirety.

The use of charge directors in liquid developers has allowed control over the charge of the toner particles, but also has had the effect of exacerbating the problem of charge exchange between the toner and the intermediate transfer member. This has been especially true with intermediate transfer materials such as VITON® B50 (a fluorocarbon elastomer copolymer of vinylidene fluoride and hexafluoropropylene available from E. I. du Pont de Nemours & Co.).

Using fluorinated carbon as a filler in fluoroelastomers helps to solve the above problems. The intermediate transfer member material of the present invention enables high yield transfer of toner particles from the photoreceptor to the intermediate transfer member due to the combination of fluorinated carbon and fluoroelastomer which provide for a stable resistivity within the desired range of from about $10^7$ to about $10^{13}$ Ω/sq. Further, such fluorinated carbon filled fluoroelastomers allow for a stable resistivity within the desired range also greatly reduces the charge exchange between the intermediate transfer member and both the toner and the charge director optionally in the developer.

Figure 2:
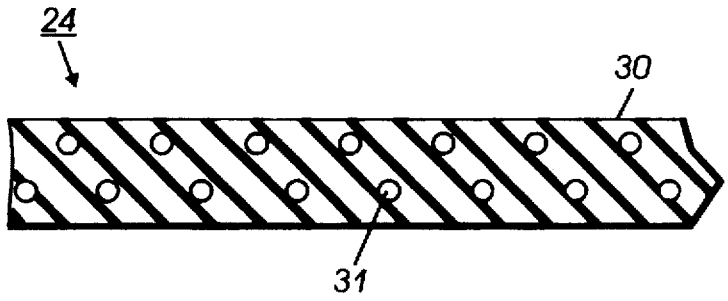
FIG. 2 is an illustration of an embodiment of the invention, wherein a one layer intermediate transfer film comprising a fluorinated carbon filled fluoroelastomer described herein is shown.

The intermediate transfer member of the present invention can be of at least three different configurations. In one embodiment of the invention, the intermediate transfer component 24 is of a single layer configuration as shown in FIG. 2. Preferably, the single layer 30 is comprised of a fluoropolymer, preferably a fluoroelastomer, and particularly preferred, a fluorinated carbon filled fluoroelastomer. The fluorinated carbon 31 is evenly dispersed in the fluoroelastomer. It is believed that the fluorinated carbon crosslinks with the fluoroelastomer. It is preferred that the surface resistivity of the single fluoropolymer layer is from about $10^7$ to about $10^{13}$ Ω/sq, preferably from about $10^9$ to about $10^{12}$ Ω/sq, and particularly preferred about $5\times10^{10}$ Ω/sq. The thickness of the single layer intermediate transfer component is from about 1 to about 30 mil, preferably from about 5 to about 15 mil. The hardness of the single layer intermediate transfer component is less than about 85 Shore A, preferably from about 45 to about 65 Shore A. An optional filler may be added to enhance mechanical strength of the single layer film. Examples of suitable fillers include MgO, CaO, ZnO, $Ca(OH)_2$ and the like. The one layer configuration can be in the form of a belt, film, or an endless flexible seamed or seamless belt or film.

Figure 3:
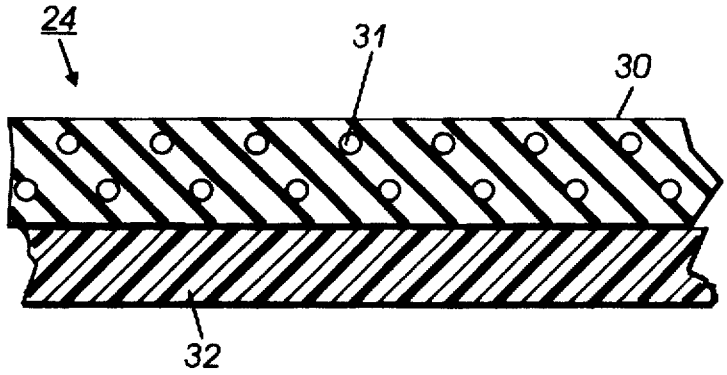
FIG. 3 is an illustration of an embodiment of the invention, wherein a two layer intermediate transfer film described herein is shown.

In another embodiment of the invention, the intermediate transfer belt 24 is of a two layer configuration as shown in FIG. 3. As shown in FIG. 3, the intermediate transfer component comprises a substrate 32, and having thereon a fluorinated carbon filled fluoroelastomer outer layer 30. The fluorinated carbon filled fluoroelastomer is as described above in the description of the embodiment shown in FIG. 2 having a fluorinated carbon filler 31 dispersed in the fluoroelastomer layer. In this two layer configuration shown in FIG. 3, the substrate is preferably a flexible film or belt made of plastic having a high resistivity. Alternatively, the substrate is a rigid roll made of a metal such as aluminum, steel, or the like. In the preferred embodiment, the substrate is a flexible belt made of a resistive plastic such as a polyimide. Specific examples of suitable polyimides include PAI (polyamideimide), PI (polyimide), polyaramide, polyphthalamide, and the like. The plastic must be capable of exhibiting high mechanical strength, be flexible, and be resistive. It is preferred that the polyimide contain a resistive filler such as carbon black, graphic or a metal oxide such as tin oxide. It is preferred that the resistivity of the substrate layer be from about $10^7$ to about $10^{13}$ Ω/sq, preferably from about $10^9$ to about $10^{12}$ Ω/sq, and particularly preferred about $5\times10^{10}$ Ω/sq. In addition, it is preferred that the plastic have a flexural strength of from about 500,000 to about 3,000,000 psi, and a flexural modulus of from about 10,000 to about 55,000 psi. The thickness of the substrate is from about 1 to about 10 mil, preferably from about 1 to about 5 mil. The fluorinated carbon filled outer layer 30 has a thickness of from about 0.5 to about 6 mil, preferably from about 1 to about 4 mil. The surface resistivity is from about $10^{7\ I\ about}$ $10^{13}$ Ω/sq, preferably from about $10^9$ to about $10^{12}$ Ω/sq, and particularly preferred about $5\times10^{10}$ Ω/sq. The hardness of the conformable outer layer is less than about 85 Shore A, and preferably from about 45 to about 65 Shore A.

Figure 4:
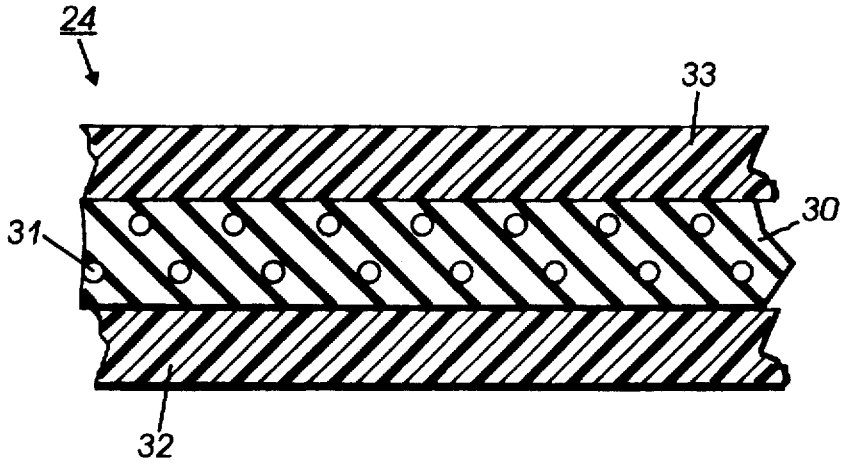
FIG. 4 is an illustration of an embodiment of the invention, wherein a three layer intermediate transfer film described herein is shown.

In another preferred embodiment of the invention, the intermediate transfer belt 24 is of a three layer configuration as shown in FIG. 4. This three layer configuration provides superior conformability and is suitable for use with liquid toner, and especially in color xerographic machines. In this three layer configuration, the intermediate transfer belt 24 comprises a substrate 32 as defined above, and having thereon an intermediate layer 30 comprised of a conformable fluorinated carbon filled fluoroelastomer layer positioned on the substrate, and an outer release layer 33. The mechanical and electrical properties of the fluorinated carbon filled fluoroelastomer layer and the substrate are as described above, wherein the intermediate layer contains a fluorinated carbon filler 31 dispersed therein. This outer layer is preferably thin, having a thickness of from about 0.1 to about 2 mils, and preferably from about 0.2 to about 1.5 mils. The outer release layer is made of a known material suitable for release such as, for example, a silicone rubber. Specific example of silicone rubbers useful herein include Silicone 552 available from Sampson Coating, Inc. Richmond, Va.; Eccosil 4952D available from Emerson Cuming, Inc., WO Burn, Mass.; Dow Corning DC-437 Silicone available from Dow Corning, Midland, Mich., and any other suitable commercially available silicone material. Preferably, the outer layer includes an optional metal oxide filler such as $Fe_2O_3$ dispersed therein. The three layer configuration works very well with liquid development and is the preferred configuration of the present invention.

The circumference of the component in a film or belt configuration of from 1 to 3 or more layers, is from about 8 to about 60 inches, preferably from about 10 to about 50 inches, and particularly preferred from about 15 to about 35 inches. The width of the film or belt is from about 8 to about 40 inches, preferably from about 10 to about 36 inches, and particularly preferred from about 10 to about 24 inches. It is preferably that the film be an endless, seamed flexible belt or a seamed flexible belt, which may or may not include puzzle cut seam(s). Examples of such belts are described in U.S. Pat. Nos. 5,487,707; 5,514,436; and U.S. Patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

The particular resistivity of the fluoropolymer conformable layer can be chosen and controlled depending, for example, on the amount of fluorinated carbon, the kind of curative, the amount of curative, the amount of fluorine in the fluorinated carbon, and the curing procedures including the specific curing agent, curing time and curing temperature. The resistivity can be generated not only by selecting the appropriate curing agents, curing time and curing temperature as set forth above, but also by selecting a specific polymer and filler, such as a specific fluorinated carbon, or mixtures of various types of fluorinated carbon. The percentage of fluorine in the fluorinated carbon will also affect the resistivity of the fluoroelastomer when mixed therewith. The fluorinated carbon which is believed to crosslink with an elastomer, provides unexpectedly superior results by providing an intermediate transfer member having a stable resistivity within the desired range which is virtually unaffected by numerous environmental and mechanical changes, and provides sufficient antistatic properties.

Fluorinated carbon, sometimes referred to as graphite fluoride or carbon fluoride is a solid material resulting from the fluorination of carbon with elemental fluorine. The number of fluorine atoms per carbon atom may vary depending on the fluorination conditions. The variable fluorine atom to carbon atom stoichiometry of fluorinated carbon permits systemic, uniform variation of its electrical resistivity properties. Controlled and specific resistivity is a highly desired feature for a conformable surface of an intermediate transfer member.

Fluorinated carbon is a specific class of compositions which is prepared by the chemical addition of fluorine to one or more of the many forms of solid carbon. In addition, the amount of fluorine can be varied in order to produce a specific, desired resistivity. Fluorocarbons are either aliphatic or aromatic organic compounds wherein one or more fluorine atoms have been attached to one or more carbon atoms to form well defined compounds with a single sharp melting point or boiling point. Fluoropolymers are linked-up single identical molecules which comprise long chains bound together by covalent bonds. Moreover, fluoroelastomers are a specific type of fluoropolymer. Thus, despite some apparent confusion in the art, it is apparent that fluorinated carbon is neither a fluorocarbon nor a fluoropolymer and the term is used in this context herein.

The fluorinated carbon material may include the fluorinated carbon materials as described herein. The methods for preparation of fluorinated carbon are well known and documented in the literature, such as in the following U.S. Pat. Nos. 2,786,874; 3,925,492; 3,925,263; 3,872,032 and 4,247,608, the disclosures each of which are totally incorporated by reference herein. Essentially, fluorinated carbon is produced by heating a carbon source such as amorphous carbon, coke, charcoal, carbon black or graphite with elemental fluorine at elevated temperatures, such as 150° to 600° C. A diluent such as nitrogen is preferably admixed with the fluorine. The nature and properties of the fluorinated carbon vary with the particular carbon source, the conditions of reaction and with the degree of fluorination obtained in the final product. The degree of fluorination in the final product may be varied by changing the process reaction conditions, principally temperature and time. Generally, the higher the temperature and the longer the time, the higher the fluorine content.

Fluorinated carbon of varying carbon sources and varying fluorine contents is commercially available from several sources. Preferred carbon sources are carbon black, crystalline graphite and petroleum coke. One form of fluorinated carbon which is suitable for use in accordance with the invention is polycarbon monofluoride which is usually written in the shorthand manner $CF_x$ with x representing the number of fluorine atoms and generally being up to about 1.5, preferably from about 0.01 to about 1.5, and particularly preferred from about 0.04 to about 1.4. The formula $CF_x$ has a lamellar structure composed of layers of fused six carbon rings with fluorine atoms attached to the carbons and lying above and below the plane of the carbon atoms. Preparation of $CF_x$ type fluorinated carbon is described, for example, in above-mentioned U.S. Pat. Nos. 2,786,874 and 3,925,492, the disclosures of which are incorporated by reference herein in their entirety. Generally, formation of this type of fluorinated carbon involves reacting elemental carbon with $F_2$ catalytically. This type of fluorinated carbon can be obtained commercially from many vendors, including Allied Signal, Morristown, N.J.; Central Glass International, Inc., White Plains, N.Y.; Diakin Industries, Inc., New York, N.Y.; and Advance Research Chemicals, Inc., Catoosa, Okla.

Another form of fluorinated carbon which has been postulated by Nobuatsu Watanabe as poly(dicarbon monofluoride) which is usually written in the shorthand manner $(C_2F)_n$. The preparation of $(C_2F)_n$ type fluorinated carbon is described, for example, in above-mentioned U.S. Pat. No. 4,247,608, the disclosure of which is herein incorporated by reference in its entirety, and also in Watanabe et al., "Preparation of Poly(dicarbon monofluoride) from Petroleum Coke", Bull. Chem. Soc. Japan, 55, 3197–3199 (1982), the disclosure of which is also incorporated herein by reference in its entirety.

In addition, preferred fluorinated carbons selected include those described in U.S. Pat. No. 4,524,119 to Luly et al., the subject matter of which is hereby incorporated by reference in its entirety, and those having the tradename Accufluor®, (Accufluor® is a registered trademark of Allied Signal, Morristown, N.J.) for example, Accufluor® 2028, Accufluor® 2065, Accufluor® 1000, and Accufluor® 2010. Accufluor® 2028 and Accufluor® 2010 have 28 and 11 percent fluorine content, respectively. Accufluor® 1000 and Accufluor® 2065 have 62 and 65 percent fluorine content respectively. Also, Accufluor® 1000 comprises carbon coke, whereas Accufluor® 2065, 2028 and 2010 all comprise conductive carbon black. These fluorinated carbons are of the formula $CF_x$ and are formed by the reaction of $C+F_2=CF_x$.

The following chart demonstrates some properties of four preferred fluorinated carbons useful in the present invention.

| PROPERTIES | ACCUFLUOR ® | | | | UNITS |
|---|---|---|---|---|---|
| GRADE | 1000 | 2065 | 2028 | 2010 | N/A |
| Feedstock | Coke | Conductive Carbon Black | | | N/A |
| Fluorine Content | 62 | 65 | 28 | 11 | % |
| True Density | 2.7 | 2.5 | 2.1 | 1.9 | g/cc |
| Bulk Density | 0.6 | 0.1 | 0.1 | 0.09 | g/cc |
| Decomposition Temperature | 630 | 500 | 450 | 380 | °C. |
| Median Particle Size | 8 | <1 | <1 | <1 | micrometers |
| Surface Area | 130 | 340 | 130 | 170 | $m^2/g$ |
| Thermal Conductivity | $10^{-3}$ | $10^{-3}$ | $10^{-3}$ | N.A. | cal/cm-sec-°C. |
| Electrical Resistivity | $10^{11}$ | $10^{11}$ | $10^{8}$ | <10 | ohm-cm |
| Color | Gray | White | Black | Black | N/A |

As has been described herein, a major advantage of the invention is the capability to be able to vary the fluorine content of the fluorinated carbon to permit systematic uniform variation of the resistivity properties of the intermediate transfer member. The preferred fluorine content will depend on the equipment used, equipment settings, desired resistivity, and the specific fluoroelastomer chosen. The fluorine content in the fluorinated carbon is from about 1 to about 70 weight percent based on the weight of fluorinated carbon (carbon content of from about 99 to about 30 weight percent), preferably from about 5 to about 65 (carbon content of from about 95 to about 35 weight 10 percent), and particularly preferred from about 10 to about 30 weight percent (carbon content of from about 90 to about 70 weight percent).

The median particle size of the fluorinated carbon can be less than 1 micron and up to 10 microns, is preferably less than 1 micron, and particularly preferred from about 0.1 to 0.9 micron. The surface area is preferably from about 100 to about 400 $m^2/g$, preferred of from about 110 to about 340, and particularly preferred from about 130 to about 170 $m^2/g$. The density of the fluorinated carbons is preferably from about 1.5 to about 3 g/cc, preferably from about 1.9 to about 2.7 g/cc.

The amount of fluorinated carbon in the conformable fluoroelastomer layer of the intermediate transfer member is from about 1 to about 50 percent by weight of the total solids content, and preferably from about 1 to about 30 weight percent based on the weight of total solids. Total solids as used herein refers to the amount of fluoroelastomer and/or other elastomers. This amount is the amount which provides a surface resistivity of the conformable layer of the intermediate transfer member of from about $10^7$ ohms/sq to about $10^{13}$ ohms/sq, preferably from about $10^9$ to about $10^{12}$, and particularly preferred is from about $5\times10^{10}$ ohms/sq.

The specific surface resistivity of the outer layer of the intermediate transfer component is important in that a resistivity within a desired range such as that set forth above will significantly decrease static related adhesion of the toner to the intermediate transfer surface and provide an opportunity to drive transfer of the toner image. The present invention, in embodiments, provides intermediate transfer system members which possess the desired resistivity. Further, the resistivity of the present intermediate transfer member is virtually unaffected by high temperature, changes in humidity, operating time, bias field, and many other environmental changes.

It is preferable to mix different types of fluorinated carbon primarily to tune the mechanical and electrical properties. For example, an amount of from about 0 to about 40 percent, and preferably from about 1 to about 35 percent by weight of Accufluor® 2010 can be mixed with an amount of from about 0 to about 40 percent, preferably from about 1 to about 35 percent Accufluor® 2028. Other forms of fluorinated carbon can also be mixed. Another example is an amount of from about 0 to about 40 percent Accufluor® 1000 mixed with an amount of from about 0 to about 40 percent, preferably from about 1 to about 35 percent Accufluor® 2065. All other combinations of mixing the different forms of Accufluor® are possible.

Examples of the conformable layers herein include polymers such as fluoropolymers. Preferred are elastomers such as fluoroelastomers. Specifically, suitable fluoroelastomers are those described in detail in U.S. Pat. Nos. 5,166,031, 5,281,506, 5,366,772 and 5,370,931, together with U.S. Pat. Nos. 4,257,699, 5,017,432 and 5,061,965, the disclosures each of which are incorporated by reference herein in their entirety. As described therein these fluoroelastomers, particularly from the class of copolymers and terpolymers of vinylidenefluoride, hexafluoropropylene and tetrafluoroethylene, are known commercially under various designations as VITON® A, VITON® E, VITON® E60C, VITON® E430, VITON® 910, VITON® GH and VITON® GF. The VITON® designation is a Trademark of E.I. DuPont de Nemours, Inc. Other commercially available materials include FLUOREL® 2170, FLUOREL® 2174, FLUOREL® 2176, FLUOREL® 2177 and FLUOREL® LVS 76 FLUOREL® being a Trademark of 3M Company. Additional commercially available materials include AFLAS™ a poly(propylene-tetrafluoroethylene) and FLUOREL II® (LII900) a poly (propylenetetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON® GF, available from E. I. DuPont de Nemours, Inc. The VITON® GF has 35 mole percent of vinylidenefluoride, 34 mole percent of hexafluoropropylene and 29 mole percent of tetrafluoroethylene with 2 percent cure site monomer. The cure site monomer can be 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known cure site monomer commercially available from DuPont or any other manufacturer.

Examples of fluoroelastomers suitable for use herein for the conformable layers herein include elastomers of the above type, along with volume grafted elastomers. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety.

Volume graft, in embodiments, refers to a substantially uniform integral interpenetrating network of a hybrid composition, wherein both the structure and the composition of the fluoroelastomer and polyorganosiloxane are substantially uniform when taken through different slices of the intermediate transfer member. A volume grafted elastomer is a hybrid composition of fluoroelastomer and polyorganosiloxane formed by dehydrofluorination of fluoroelastomer by nucleophilic dehydrofluorinating agent followed by addition polymerization by the addition of alkene or alkyne functionally terminated polyorganosiloxane.

Interpenetrating network, in embodiments, refers to the addition polymerization matrix where the fluoroelastomer and polyorganosiloxane polymer strands are intertwined in one another.

Hybrid composition, in embodiments, refers to a volume grafted composition which is comprised of fluoroelastomer and polyorganosiloxane blocks randomly arranged.

Generally, the volume grafting according to the present invention is performed in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer. In embodiments, copper oxide can be added to a solution containing the graft copolymer. The dispersion is then provided onto the intermediate transfer member or conductive film surface.

In embodiments, the polyorganosiloxane having functionality according to the present invention has the formula:

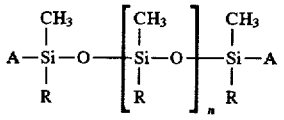

where R is an alkyl from about 1 to about 24 carbons, or an alkenyl of from about 2 to about 24 carbons, or a substituted or unsubstituted aryl of from about 4 to about 18 carbons; A is an aryl of from about 6 to about 24 carbons, a substituted or unsubstituted alkene of from about 2 to about 8 carbons, or a substituted or unsubstituted alkyne of from about 2 to about 8 carbons; and n represents the number of segments and is, for example, from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 6 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

In a preferred single layer embodiment of the invention, the conformable layer is comprised of a fluorinated carbon filled fluoroelastomer, wherein the fluoroelastomer is VITON GF® and the fluorinated carbon is selected from Accufluor® 1000, Accufluor® 2065, Accufluor® 2028, Accufluor® 2010, or mixtures thereof.

The amount of fluoroelastomer used to provide the conformable layers of the present invention is dependent on the amount necessary to form the desired thickness of the layer or layers. Specifically, the fluoroelastomer for the outer layer is added in an amount of from about 60 to about 99 percent, preferably about 70 to about 99 percent by weight of total solids.

Any known solvent suitable for dissolving a fluoroelastomer may be used in the present invention. Examples of suitable solvents for the present invention include methyl ethyl ketone, methyl isobutyl ketone, diethyl ketone, cyclohexanone, n-butyl acetate, amyl acetate, and the like. Specifically, the solvent is added in an amount of from about 25 to about 99 percent, preferably from about 70 to about 95 percent.

The dehydrofluorinating agent which attacks the fluoroelastomer generating unsaturation is selected from basic metal oxides such as MgO, CaO, $Ca(OH)_2$ and the like, and strong nucleophilic agents such as primary, secondary and tertiary, aliphatic and aromatic amines, where the aliphatic and aromatic amines have from about 2 to about 30 carbon atoms. Also included are aliphatic and aromatic diamines and triamines having from about 2 to about 30 carbon atoms where the aromatic groups may be benzene, toluene, naphthalene, anthracene, and the like. It is generally preferred for the aromatic diamines and triamines that the aromatic group be substituted in the ortho, meta and para positions. Typical substituents include lower alkyl amino groups such as ethylamino, propylamino and butylamino, with propylamino being preferred. The particularly preferred curing agents are the nucleophilic curing agents such as VITON CURATIVE VC-50® which incorporates an accelerator (such as a quaternary phosphonium salt or salts like VC-20) and a crosslinking agent (bisphenol AF or VC-30); DIAK 1 (hexamethylenediamine carbamate) and DIAK 3 (N,N'-dicinnamylidene-1,6 hexanediamine). The dehydrofluorinating agent is added in an amount of from about 1 to about 20 weight percent, and preferably from about 2 to about 10 weight percent.

Optional intermediate adhesive layers and/or polymer layers may be applied to achieve desired properties and performance objectives of the present conductive film. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned adhesives is Dow H41.

In the two layer configuration, there may be provided an adhesive layer between the substrate and the outer fluoropolymer layer. In the three layer configuration, there may also be an adhesive layer between the intermediate conductive fluoropolymer layer and the outer silicone layer, and/or between the intermediate fluoroelastomer layer and the polyimide substrate.

The layer or layers may be deposited on the substrate via a well known coating processes. Known methods for forming the outer layer(s) on the substrate film such as dipping, spraying such as by multiple spray applications of very thin films, casting, flow-coating, web-coating, roll-coating, extrusion, molding, or the like can be used. It is preferred to deposit the layers by spraying such as by multiple spray applications of very thin films, by web coating or by flow-coating.

The intermediate transfer components having a conformable layer comprising a fluorinated carbon filled fluoroelastomer exhibit superior electrical and mechanical properties. The components are designed so as to enable control of electrical properties including control of conductivity in the desired resistivity range, wherein the conductivity is virtually insensitive to environmental changes. Further, the components have a reduced surface energy which helps to maintain excellent release properties. Moreover, the intermediate transfer components herein allow for neutralization of residual toner charge, which ultimately improves image quality. In addition, the intermediate transfer components herein have good conformability.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example I

A resistive layer containing 30% by weight of ACCUFLUOR® 2028 in VITON® GF was prepared in the following manner. The coating dispersion was prepared by first adding a solvent (200 g of methyl ethyl ketone), a steel shot (2,300 g) and 19.5 g of ACCUFLUOR® 2028 in a small bench top attritor (model 01A). The mixture was stirred for about one minute so as to wet the fluorinated carbon. A polymer binder, VITON® GF (45 g) was then added and the resulting mixture was attrited for 30 minutes. A curative package (2.25 g VC-50, 0.9 g Maglite-D and0.2 G $Ca(OH)_2$) and a stabilizing solvent (10 g methanol) were then introduced and the resulting mixture was further mixed for another 15 minutes. After filtering the steel shot through a wire screen, the dispersion was collected in a polypropylene bottle. The resulting dispersion was then coated onto KAPTON® substrates within 2–4 hours using a Gardner Laboratory coater. The coated layers were air-dried for approximately two hours and then step heat cured in a programmable oven. The heating sequence was as follows: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. This resulted in a VITON® GF layer containing 30% by weight ACCUFLUOR® 2028. The dry thickness of the layers was determined to be approximately 3 mil (~75 μm).

The surface resistivity of the cured VITON GF® layers was measured by a Xerox Corporation in-house testing apparatus consisting of a power supply (Trek 601C Coratrol), a Keithy electrometer (model 610B) and a two point conformable guarded electrode probe (15 mm spacing between the two electrodes). The field applied for the measurement was 500 V/cm and the measured current was converted to surface resistivity based on the geometry of the probe. The surface resistivity of the layer was determined to be ~$1\times10^9$ ohm/sq.

The volume resistivity of the layer was determined by the standard AC conductivity technique. The surface of the VITON GF® was coated directly onto a stainless steel substrate, in the absence of an intermediate layer. An evaporated aluminum thin film (300 Å) was used as the counter electrode. The volume resistivity was found to be approximately $1\times10^9$ ohm-cm at an electric field of 1500 V/cm. Surprisingly, the resistivity was found to be insensitive to changes in temperature in the range of about 20° C. to about 150° C., and to changes in relative humidity in the range of about 20% to about 80%, and to the intensity of applied electric field (up to 2,000 V/cm). Furthermore, no hysteresis (memory) effect was seen after the layer was cycled to higher electric fields (>$10^4$ V/cm).

Example II

A number of resistive layers were prepared using various percentages by weight of ACCUFLUOR® 2028 and ACCUFLUOR® 2010 following the procedures described in Example I. These layers were found to exhibit very similar electric properties as the layers in Example 1 when measured following the same procedures. The data is summarized in Table I.

TABLE I

Resistivity Data of Fluorinated Carbon in VITON ® GF (field ~1500 V/cm)

| Fluorinated Carbon | Loading (% by weight) | Surface Resistivity (ohm/sq) | Volume Resistivity (ohm-cm) |
|---|---|---|---|
| ACCUFLUOR ® 2028 | 35 | $1.7\times10^7$ | ~$1.6\times10^8$ |
| ACCUFLUOR ® 2028 | 25 | $1.0\times10^{10}$ | ~$6\times10^{11}$ |

TABLE I-continued

Resistivity Data of Fluorinated Carbon in VITON ® GF (field ~1500 V/cm)

| Fluorinated Carbon | Loading (% by weight) | Surface Resistivity (ohm/sq) | Volume Resistivity (ohm-cm) |
|---|---|---|---|
| ACCUFLUOR ® 2028 | 20 | $8.9 \times 10^{11}$ | $\sim 2 \times 10^{13}$ |
| ACCUFLUOR ® 2010 | 30 | $8.3 \times 10^{4}$ | |
| ACCUFLUOR ® 2010 | 10 | $1.9 \times 10^{5}$ | |
| ACCUFLUOR ® 2010 | 5 | $4.1 \times 10^{5}$ | |
| ACCUFLUOR ® 2010 | 3.5 | $4.5 \times 10^{6}$ | |
| ACCUFLUOR ® 2010 | 3 | $1.7 \times 10^{8}$ | |

Example III

A number of resistive layers were prepared using the dispersing and coating procedure as described in Example I, with the exception that a mixture of various percentages by weight of various types of ACCUFLUOR®s were mixed with VITON® GF. The compositions of the ACCUFLUOR®/NITON® GF layers and the surface resistivity results are summarized in Table 2.

TABLE 2

| Fillers in VITON ® GF (%) | Surface Resistivity (ohm/sq) |
|---|---|
| 2% ACCUFLUOR ® 2010<br>15% ACCUFLUOR ® 2028 | $4.5 \times 10^{11}$ |
| 2.5% ACCUFLUOR ® 2010<br>15% ACCUFLUOR ® 2028 | $1.0 \times 10^{9}$ |
| 3% ACCUFLUOR ® 2010<br>5% ACCUFLUOR ® 2028 | $5.4 \times 10^{9}$ |
| 3% ACCUFLUOR ® 2010<br>10% ACCUFLUOR ® 2028 | $6.4 \times 10^{9}$ |
| 3% ACCUFLUOR ® 2010<br>15% ACCUFLUOR ® 2028 | $1.3 \times 10^{10}$ |
| 3.5% ACCUFLUOR ® 2010<br>5% ACCUFLUOR ® 2028 | $2 \times 10^{9}$ |
| 3.5% ACCUFLUOR ® 2010<br>15% ACCUFLUOR ® 2028 | $7.2 \times 10^{9}$ |

Example IV

Resistive layers of 25% by weight of ACCUFLUOR® in VITON® GF were prepared according to the procedures described in Example I. However, instead of performing a post-curing at 232° C. for 16 hours, the post-curing was performed for 9 hours, 26 hours, 50 hours, 90 hours and 150 hours, respectively. The surface resistivity results are shown in Table 3.

TABLE 3

| Post-curing Time | Surface Resistivity (ohm/sq) |
|---|---|
| 9 hours | $5.5 \times 10^{10}$ |
| 26 hours | $8.8 \times 10^{9}$ |
| 50 hours | $1.8 \times 10^{9}$ |
| 90 hours | $7.3 \times 10^{7}$ |
| 150 hours | $7.2 \times 10^{6}$ |

Example V

Coating dispersions containing different concentrations of ACCUFLUOR® 2010 in VITON® GF were prepared using the attrition procedures given in Example I. These dispersions were then air-sprayed onto KAPTON® substrates. The layers (~2.5 mil) were air-dried and post-cured using the procedure outlined in Example I. The surface resistivity results are summarized in Table 4 below. The percentages are by weight.

TABLE 4

| ACCUFLUOR ® 2010 Loading in VITON ® GF (%) | Surface Resistivity (ohm/sq) |
|---|---|
| 6% | $1.6 \times 10^{12}$ |
| 7% | $7.0 \times 10^{8}$ |
| 8% | $8.5 \times 10^{7}$ |
| 10% | $6.2 \times 10^{6}$ |
| 20% | $1.1 \times 10^{5}$ |

Example VI

A resistive layer of 30% ACCUFLUOR® 2028 in VITON® GF was prepared according to the procedures described in Example I, with the exception that 4.5 g of curative VC-50 was used. The surface resistivity of the layer was measured using the techniques outlined in Example 1 and was found to be approximately $5.7 \times 10^{9}$ ohm/sq.

Example VII

A coating dispersion was prepared by first adding a solvent (200 g of methyl ethyl ketone), a steel shot (2,300 g) and 2.4 g of ACCUFLUOR® 2028 in a small bench top attritor (model 01A). The mixture was stirred for about one minute so as to wet the fluorinated carbon with the solvent. A polymer binder, VITON® GF (45 g), was then added and the resulting mixture was attrited for 30 minutes. A curative package (0.68 g DIAK 1 and 0.2 g Maglite Y) and a stabilizing solvent (10 g methanol) were then introduced and the mixture was further mixed for about 15 minutes. After filtering the steel shot through a wire screen, the fluorinated carbon/VITON® GF dispersion was collected in a polypropylene bottle. The dispersion was then coated onto KAPTON® substrates within 2–4 hours using a Gardner laboratory coater. The coated layers were first air-dried for approximately two hours and then heat cured in a programmable oven. The heating sequence was: (1) 65° C. for 4 hours, (2) 93° C. for 2 hours, (3) 144° C. for 2 hours, (4) 177° C. for 2 hours, (5) 204° C. for 2 hours and (6) 232° C. for 16 hours. A resistive layer (~3 mil) consisting of 5% by weight ACCUFLUOR® 2028 in VITON® GF was formed. The surface resistivity of the layer was measured according to the procedures of Example I and was found to be approximately $1 \times 10^{8}$ ohm/sq.

Example VIII

A resistive layer of 5% by weight ACCUFLUOR® 2028 in VITON® GF was prepared according to the procedures in Example VII, with the exception that 1.36 g of DIAK 1 was used as the curative. The surface resistivity of the layer was measured at $1 \times 10^{5}$ ohm/sq.

Example IX

A coating dispersion was prepared by first adding a solvent (200 g of methyl ethyl ketone), a steel shot (2,300 g) and 1.4 g of ACCUFLUOR® 2028 in a small bench top attritor (model 01A). The mixture was stirred for about one minute so that the fluorinated carbon became wet. A polymer binder, VITON® GF (45 g), was then added and the resulting mixture was attrited for 30 minutes. A curative package (1.36 g DIAK 3 and 0.2 g Maglite Y) and a stabilizing solvent (10 g methanol) were then introduced and the resulting mixture was further mixed for another 15 minutes. After filtering the steel shot through a wire screen, the fluorinated carbon/VITON® GF dispersion was collected in a polypropylene bottle. The dispersion was then coated onto KAPTON® substrates within 2–4 hours using a Gardner Laboratory coater. The coated layers were first air-dried for approximately 2 hours and then heat cured in a programmable oven. The heat curing sequence was: (1) 65° C. for 4 hours, (2) 93° C. 2 hours, (3) 144° C. for 2 hours, (4) 177° C. for 2 hours, (5) 204° C. for 2 hours and (6) 232° C. for 16 hours. A resistive layer (~3 mil) consisting of 3% ACCUFLUOR® 2028 in VITON® GF was formed. The surface resistivity of the layer was approximately $8\times10^6$ ohm/sq.

Example X

Resistive layers of 5% ACCUFLUOR® 2028 in VITON® GF were prepared using the dispersion and coating procedures as outlined in Example VII, with the exception that the curing times and the curing temperatures were changed. The surface resistivities of these layers are summarized in Table 5.

TABLE 5

| Curing Temperature (°C.) | Curing time (hours) | Surface Resistivity (ohm/sq) |
|---|---|---|
| 232 | 2 | $3.6 \times 10^8$ |
| 232 | 4.5 | $1.2 \times 10^8$ |
| 232 | 8 | $1.0 \times 10^8$ |
| 195 | 2 | $1.9 \times 10^{10}$ |
| 195 | 4.5 | $6.0 \times 10^9$ |
| 195 | 8 | $7.7 \times 10^9$ |
| 195 | 23 | $3.4 \times 10^9$ |
| 175 | 4.5 | $5.2 \times 10^{10}$ |
| 175 | 23 | $2.0 \times 10^{10}$ |
| 149 | 8 | $5.2 \times 10^{11}$ |
| 149 | 23 | $2.3 \times 10^{11}$ |

Example XI

Resistive layers of 3% by weight ACCUFLUOR® 2028 in VITON® GF were prepared using the dispersion and coating procedures as described in Example IX, with the exception that the curing times and the curing temperatures were changed. The surface resistivities of these layers are summarized in Table 6.

TABLE 6

| Curing Temperature (°C.) | Curing time (hours) | Surface Resistivity (ohm/sq) |
|---|---|---|
| 235 | 2.5 | $8.1 \times 10^6$ |
| 235 | 6 | $8.0 \times 10^6$ |
| 235 | 8 | $8.0 \times 10^6$ |
| 175 | 2.5 | $6.6 \times 10^8$ |
| 175 | 6 | $4 \times 10^8$ |
| 175 | 24 | $8.8 \times 10^7$ |
| 149 | 2.5 | $1.2 \times 10^{10}$ |
| 149 | 6 | $7.5 \times 10^9$ |
| 149 | 8.5 | $6.1 \times 10^9$ |
| 149 | 24 | $2.5 \times 10^9$ |

Example XII

An intermediate transfer belt of an fluorinated carbon filled fluoroelastomer resistive layer can be fabricated in the following manner. A coating dispersion containing ACCUFLUOR® 2028 and VITON® GF in a weight ratio of 1 to 3 can be prepared according to the procedures outlined in Examples I and II above. An approximately 3 mil thick ACCUFLUOR®/VITON® resistive layer can then be prepared by web-coating the dispersion onto a resistive KAPTON® substrate (available from DuPont and having a surface resistivity of about $10^{10}$ ohm/sq). The coated layer can then be dried and cured using the conditions outlined in Example I. The surface resistivity of the ACCUFLUOR®/VITON® layer is estimated to be about 10ohm/sq and the hardness is estimated to be about 85 Shore A.

Example XIII

A coating dispersion containing ACCUFLUOR® 2028, ACCUFLUOR® 2010, and VITON® GF in a weight ratio of 2:3:95 can be prepared according to the procedures outlined in Example I. An approximately 3 mil thick ACCUFLUOR®/VITON® layer can be prepared by web-coating the dispersion onto a resistive KAPTON® substrate (available from DuPont and having a surface resistivity of about $10^{10}$ ohm/sq). The coated layer can then be dried and cured using the process described in Example I. The resulting film can be used as an intermediate transfer belt. The surface resistivity of the ACCUFLUOR®VITON® layer is estimated to be about $10^{10}$ ohm/sq and the hardness is estimated to be about 65 Shore A.

Example XIV

A multilayer intermediate transfer belt consisting of a DuPont resistive KAPTON® substrate having thereon an ACCUFLUOR®/VITON® resistive layer having thereon a silicone outer layer can be prepared by web-coating a silicone layer onto the layers prepared in Examples XII, XIII and XIV. After coating, the silicone layer can be dried and the entire layered structure can be cured at 120° C. for 3 hours, 177° C. for 4 hours and finally, 232° C. for 2 hours. The multilayer intermediate transfer belts can be particularly suitable for application in liquid xerography.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A resistive transfer component comprising at least one fluorinated carbon filled fluoroelastomer layer.

2. A resistive transfer component in accordance with claim 1, wherein the fluorinated carbon has a fluorine content of from about 10 to about 30 weight percent based on the weight of fluorinated carbon, and a carbon content of from about 90 to about 70 weight percent based on the weight of fluorinated carbon.

3. A resistive transfer component in accordance with claim 1, wherein said fluorinated carbon is selected from the group consisting of a fluorinated carbon having a fluorine content of 62 weight percent, a fluorinated carbon having a fluorine content of 11 weight percent, a fluorinated carbon having a fluorine content of 28 weight percent, and a fluorinated carbon having a fluorine content of 65 weight percent based on the weight of fluorinated carbon.

4. A resistive transfer component in accordance with claim 1, wherein the fluoroelastomer is selected from the group consisting of a) copolymers of vinylidenefluoride, hexafluoropropylene and tetrafluoroethylene, b) terpolymers of vinylidenefluoride, hexafluoropropylene and tetrafluoroethylene, and c) tetra polymers of vinylidenefluoride, hexafluoropropylene, tetrafluoroethylene and a cure site monomer.

5. A resistive transfer component in accordance with claim 4, wherein the fluoroelastomer comprises 35 mole percent of vinylidenefluoride, 34 mole percent of hexafluoropropylene and 29 mole percent of tetrafluoroethylene.

6. A resistive transfer component in accordance with claim 1, wherein the fluoroelastomer is present in an amount of from about 70 to about 99 percent by weight based on the weight of total solids.

7. A resistive transfer component in accordance with claim 1, with a surface resistivity of from about $10^7$ to about $10^{13}$ ohms/sq.

8. A resistive transfer component in accordance with claim 1, with a thickness of from about 5 to about 15 mils.

9. A resistive transfer component in accordance with claim 1, with a hardness of from about 45 to about 65 Shore A.

10. A resistive transfer component in accordance with claim 1, further comprising a metal oxide filler dispersed therein.

11. A resistive transfer component in accordance with claim 1, further comprising a polyimide substrate, wherein said fluorinated carbon fluoroelastomer layer is in contact with said polyimide substrate.

12. A resistive transfer component in accordance with claim 11, wherein said polyimide substrate contains a filler selected from the group consisting of carbon black, graphite and metal oxides.

13. A resistive transfer component in accordance with claim 11, wherein said polyimide substrate has a surface resistivity of from about $10^7$ to about $10^{13}$ ohms/sq.

14. A resistive transfer component in accordance with claim 11, wherein said polyimide substrate has a thickness of from about 1 to about 5 mils.

15. A resistive transfer component in accordance with claim 11, further comprising an outer silicone release layer positioned on said fluorinated carbon filled fluoroelastomer layer.

16. A resistive transfer belt comprising at least one fluorinated carbon filled fluoroelastomer layer.

17. A resistive transfer belt for transferring a liquid image having at least a liquid carrier with toner particles dispersed therein from a member to a substrate, comprising a polyimide substrate, and having thereon a fluorinated carbon filled fluoroelastomer intermediate layer, and positioned thereon an outer silicone release layer.

18. A resistive transfer component comprising at least one fluorinated carbon filled fluoroelastomer layer, wherein said fluorinated carbon is present in an amount of from about 1 to about 30 percent by weight based on the weight of total solids.

19. A resistive transfer component comprising at least one fluorinated carbon filled fluoroelastomer layer, wherein the fluorinated carbon is of the formula $CF_x$, wherein x represents the number of fluorine atoms and is a number of from about 0.02 to about 1.5.

20. An apparatus for forming images on a recording medium comprising:

a charge-retentive surface to receive an electrostatic latent image thereon;

a development component to apply toner to said charge-retentive surface to develop said electrostatic latent image and to form a developed image on said charge retentive surface;

a resistive transfer component to transfer the developed image from said charge retentive surface to a substrate, wherein said transfer component comprises a polyimide substrate, containing thereon a fluorinated carbon filled fluoroelastomer intermediate layer, and positioned on said intermediate layer an outer silicone release layer; and a fixing component.

* * * * *